US005944265A

United States Patent [19]

Ganser, IV et al.

[11] Patent Number: 5,944,265

[45] Date of Patent: Aug. 31, 1999

[54] GYRATORY CRUSHER HAVING SELF-CONTAINED LUBRICATION SYSTEM

[75] Inventors: William A. Ganser, IV, Eugene, Oreg.; Joseph E. Musil, Ely, Iowa; Donald W. Henry, Chelsea, Iowa; Mark Hunt, Cedar Rapids, Iowa; David A. Ostergaard, Cedar Rapids, Iowa; John C. Vendelin, Cedar Rapids, Iowa; Peter Alford, Cheshire, Oreg.; Roger M. Clark, Springfield, Oreg.; Jon Juhlin, Dexter, Oreg.; James Mitchell; Gerald E. Parker, both of Eugene, Oreg.

[73] Assignee: Cedarapids, Inc., Cedar Rapids, Iowa

[21] Appl. No.: 08/786,034

[22] Filed: Jan. 21, 1997

Related U.S. Application Data

[62] Division of application No. 08/617,346, Mar. 18, 1996, Pat. No. 5,718,390.

[51] Int. Cl.[6] ..... B02C 25/00

[52] U.S. Cl. ..... 241/36; 241/207

[58] Field of Search ..... 241/207–216, 241/36; 184/6.1

[56] References Cited

U.S. PATENT DOCUMENTS

| | | | |
|---|---|---|---|
| Re. 19,538 | 4/1935 | Rumpel | 241/216 |
| 2,484,971 | 10/1949 | Traylor | 241/216 |
| 2,579,238 | 12/1951 | Lippmann | 241/216 |
| 2,713,461 | 7/1955 | Kuelgaard | 241/216 |
| 3,692,249 | 9/1972 | Decker et al. | 241/216 |
| 3,837,430 | 9/1974 | Decker et al. | 184/6.1 |
| 4,209,079 | 6/1980 | Marchal et al. | 184/6.1 |

*Primary Examiner*—Mark Rosenbaum

*Attorney, Agent, or Firm*—Marshall, O'Toole, Gerstein, Murray & Borun

[57] ABSTRACT

A gyratory crusher for crushing material having a frame mechanism including a lower frame portion; a crusher head having a bottom surface; a mounting mechanism for pivotally and gyrationally mounting the crusher head on the lower frame portion wherein the mounting mechanism includes a plurality of hydrostatic bearings configured to form a sliding engagement with the bottom surface of the crusher head to operatively support the crusher head; a drive train configured to operatively connect said mounting mechanism to an external power source; and a self-contained lubricating system for operatively lubricating the mounting mechanism and the drive train, wherein the self-contained lubricating system includes a flow divider configured to separately distribute lubricant to each hydrostatic bearing of the plurality of hydrostatic bearings wherein the flow divider is further configured to operatively provide lubricant to each sliding engagement of the plurality of hydrostatic bearings such that the crusher head is slightly elevated from the plurality of hydrostatic bearings, a monitoring system for monitoring the volume rate of lubricant flowing through the flow divider wherein the monitoring system is configured to operatively signal shut-down of the gyratory crusher as the volume rate decreases below a predetermined level, a pressure transducer configured to operatively signal shut-down of the gyratory crusher in the event that pressure of the lubricant to the flow divider decreases below a predetermined level, and a relief valve configured to prevent pressure of the lubricant to the flow divider from exceeding a pre-determined level.

13 Claims, 9 Drawing Sheets

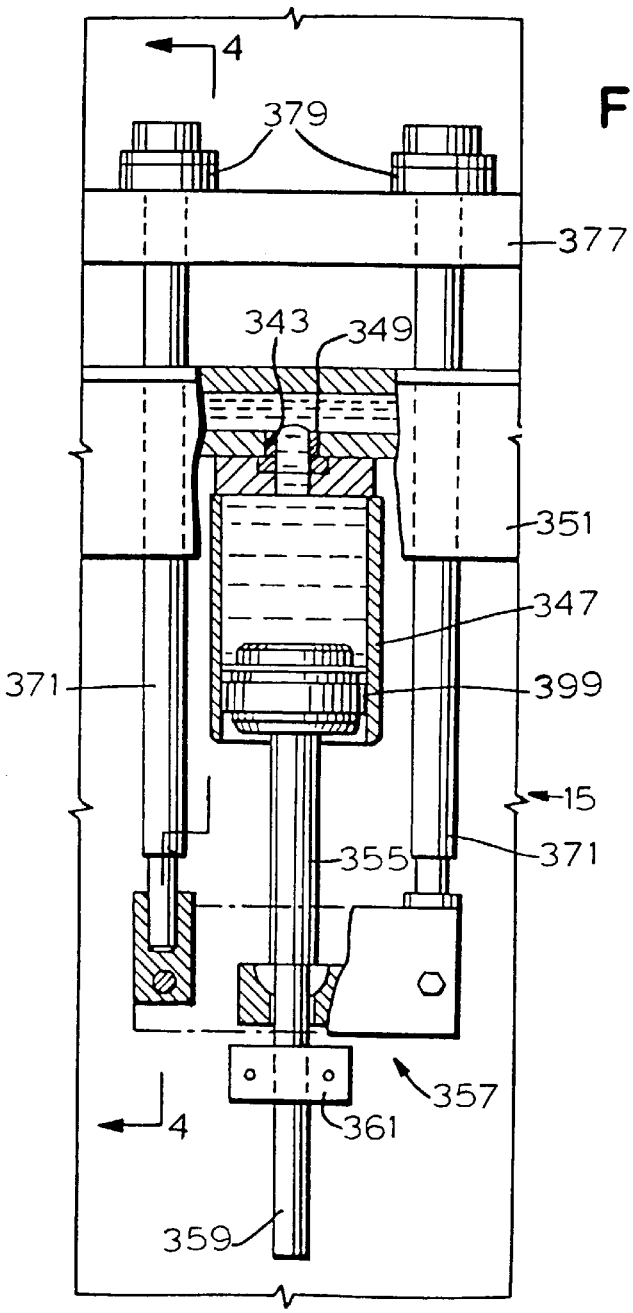
FIG. 3
FIG. 4
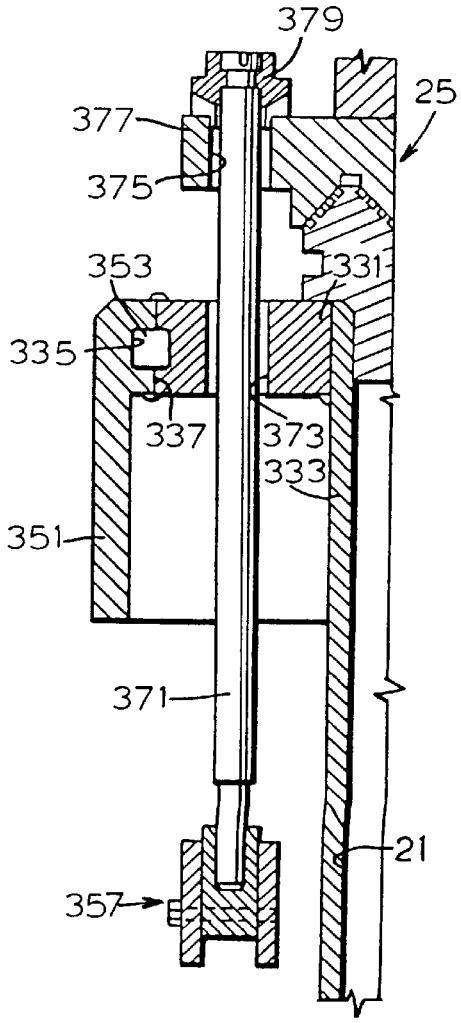

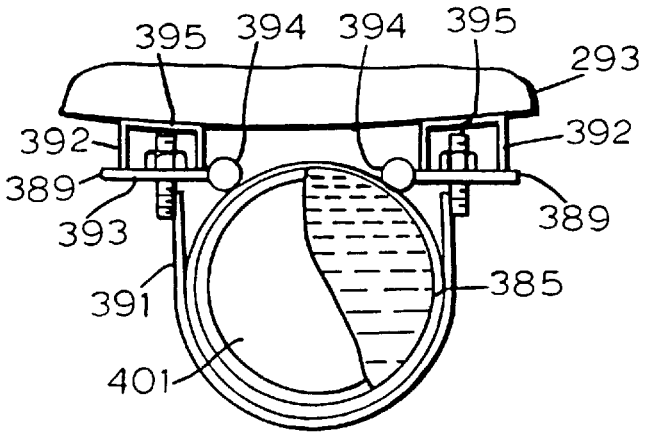
FIG. 5
FIG. 6
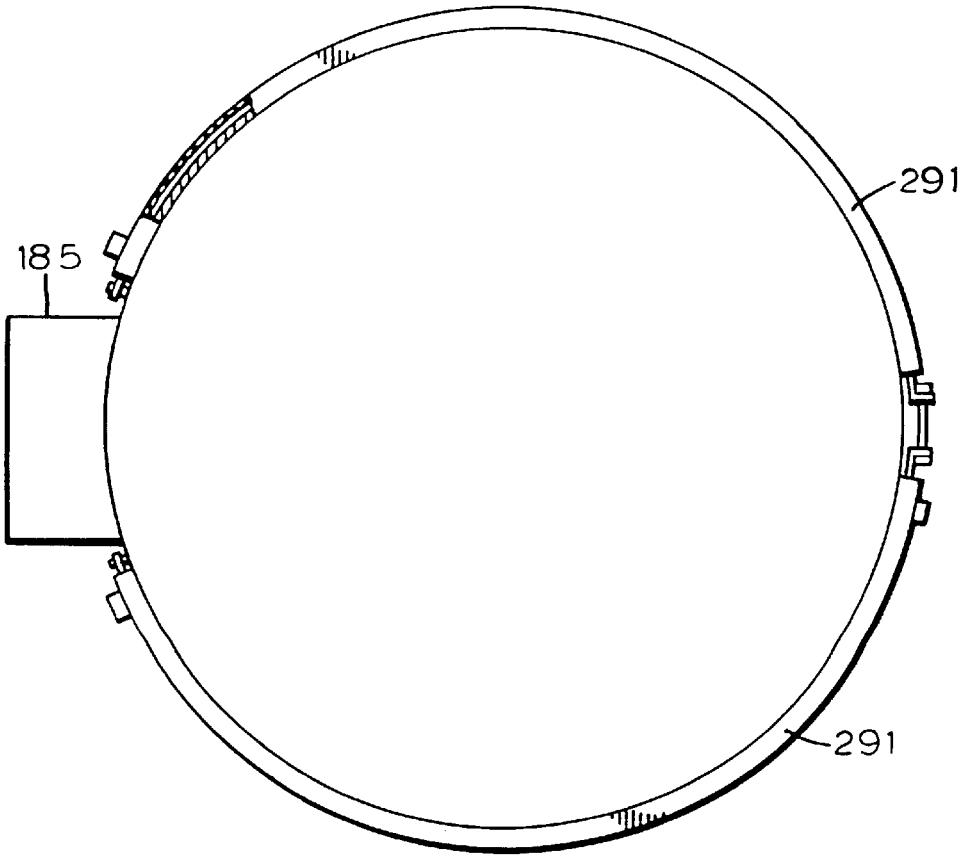

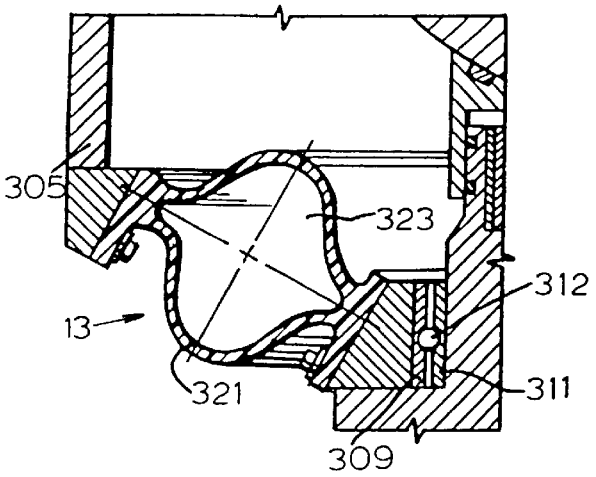
FIG. 12
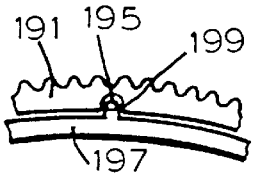
FIB. 14
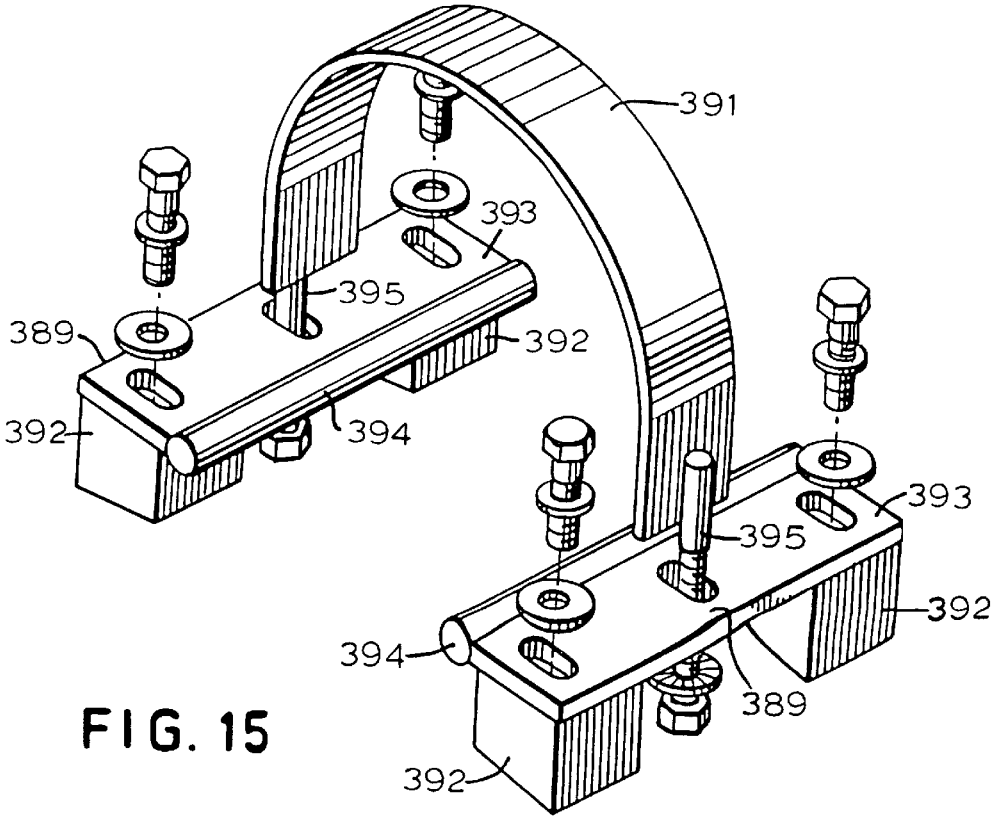
FIG. 15

GYRATORY CRUSHER HAVING SELF-CONTAINED LUBRICATION SYSTEM

This application is a divisional of application Ser. No. 08/617,346, filed Mar. 18, 1996, now U.S. Pat. No. 5,718, 390.

BACKGROUND OF THE INVENTION

The invention relates generally to a gyratory or cone crusher.

Gyratory crushers or cone crushers are characterized by crushing heads having a generally cone-shaped outer surface, which are mounted to undergo gyratory motion. The cone-shaped crushing head of a gyratory crusher is generally centered about a cone axis that is angularly offset from a vertical crusher axis generally centered through the crusher. The outer surface of the head is protected by a replaceable mantel.

The crushers are further characterized by a bowl-shaped member, sometimes referred to as a concave or bonnet, disposed in an inverted position generally over the cone-shaped crushing head and centered on the vertical crusher axis. The inner surface of the bowl-shaped member is protected by a replaceable bowl liner. The outer dimensions of the head and mantel are smaller than the corresponding inner dimensions of the bowl liner. The head is mounted such that there is a space between the mantel and the bowl liner, sometimes referred to as the "crushing chamber" or "crushing cavity". The volume of the crushing cavity can be increased by altering the shape of the exposed surface of the bowl liner and/or the shape of the exposed surface of the mantel. It can also be increased or decreased by vertically adjusting the separation between the mantel and the bowl lines. The bowl-shaped member has an upper opening through which material to be crushed can be fed into the crushing cavity.

The smallest distance between the mantel and the bowl liner at the bottom of the crushing cavity is called the "closed side setting" or "setting" of the crusher. The width of the setting determines the size of crushed materials operably produced by the crusher. The setting can be enlarged to increase the size of the crushed material produced by the crusher, and can be decreased to reduce the size of the crushed material produced by the crusher. The setting can be adjusted by simply raising or lowering the elevation of the bowl liner relative to the elevation of the cone head. The setting of some cone crushers is adjusted by raising or lowering the head. The difference between the width of the closed side setting and the spacing between the mantel and the bowl liner at the bottom of the crushing cavity directly opposite from the closed side setting, sometimes called the "open" side or "open side setting", is called the "thrown" or "stroke" of the crusher.

The small angular offset of the cone axis relative to the vertical crusher axis is provided by mounting the head on an eccentric element, or other suitable mounting. The head is caused to gyrate relative to the bowl-shaped member by rotating that mounting or eccentric element. As the eccentric element rotates, one side of the head is caused to approach the bowl liner until it attains the closed side setting while the opposite side of the head recedes from the bowl liner until it simultaneously attains the open side setting. The closed side setting and open side setting operably travel around the periphery of the lower end of the crushing cavity as the eccentric element is rotated, each making a complete revolution around the cone head for each revolution of the eccentric element. The magnitude of the gyration is determined by the angle that the cone axis is offset from the crusher axis and by the location of the point at which those two axes most closely approach or intersect.

State-of-the-art gyratory or cone crushers are generally driven by a horizontally disposed countershaft which radially extends into a lower part of a generally cylindrical crusher housing. An inner end of the countershaft is coupled through a pinion and ring gear to the eccentric element to rotatably drive the eccentric element.

A motor (either electric or combustion) is used to drive the crusher. The speed of the motor, the size ratio of the pulleys on the motor and the crusher, and the gearing of the eccentric element determine the speed at which the head gyrates, sometimes referred to as the "gyrational speed". The gyrational speed selected for each crusher depends on the particular application for which the crusher is to be used. Increasing or decreasing the gyrational speed is usually a matter of changing the speed of the motor, changing the relative sizes of the pulleys on the motor and the crusher, and/or changing the gear ratios for the eccentric.

The gyratory or gyrating motion of the cone-shaped crushing head performs a material comminution action on material, such as rock, ore, coal and other hard substances, as the material is fed through the bowl opening into the crushing cavity. The material typically moves by gravity through the annular space between the exposed surface of the stationary bowl liner and the exposed surface of the cone-shaped mantel. As the gyrating head approaches the liner, it crushes the material; as it recedes from the liner, the material falls farther down the crushing cavity to undergo further crushings during subsequent revolutions of the eccentric member and as the separation between the bowl liner and the head gradually decreases from top to bottom. This progressive crushing action repeatedly occurs until the crushed material is discharged from the bottom of the crushing cavity.

A continuing problem with prior art cone crushers is the provision of reliable and inexpensive dust seals to prevent dust and grit, that is invariably generated in abundance during the crushing operation, from gaining access to critical moving parts. The problem arises from the need to attach one side of such a seal to a portion of a crusher that moves relative to another portion of the crusher to which the other side of the seal must be attached.

Another problem with cone crushers is the external plumbing used for tramp iron relief systems for automatically processing uncrushable material through the crushing chamber. The plumbing, being exposed on the exterior of the crushers, is largely unprotected and prone to accidental damage and disruption.

A further desirable improvement for a cone crusher would be the provision of a self-contained lubricating system whereby auxiliary equipment located externally to the crusher could be eliminated. A related desirable improvement would be to provide a more reliable and simpler method of supporting the gyrating head of the crusher and distributing lubricating oil within the crusher.

Another problem with prior art cone crushers is the thermal stresses that develop within the lower frameworks of the crushers. The thermal stresses arise due to the difference in temperature of the working parts of the crushers during the crushing operation relative to the temperature of the outer walls of the lower framework. The temperature difference is acerbated by the crushed material being discharged against and sliding down the outer walls of the lower framework thereby cooling those walls, sometimes to a temperature lower than ambient.

Another desirable improvement for a cone crusher would be to accurately and precisely locate the eccentric element thereof whereby the drive assembly associated therewith could be simplified without sacrificing long-wear characteristics and reliability.

What is needed is a gyratory crusher that has a dust seal that reliably and inexpensively prevents dust and grit from gaining access to critical moving parts of the crusher; that has a tramp iron relief system without external plumbing; that has a self-contained lubricating system; that has a simpler and more reliable cone head mounting and supporting system; that has a precisely and accurately located eccentric element, even during the crushing operating; that allows simplification of the drive arrangement thereof; that has a thermal relief system whereby temperature differences between moving parts of the cone head supporting system and walls of the lower framework of the crusher are reduced; and that has easily replaceable parts that minimize maintenance costs.

SUMMARY OF THE INVENTION

An improved gyratory crusher is provided for crushing rock, ore, coal and other hard substances. The gyratory crusher includes a lower frame portion, an upper frame portion supported by the lower frame portion, and a bonnet supported by the upper frame portion. The bonnet has an upper opening for receiving the material to be crushed.

The gyratory crusher also includes an eccentric member and a conically shaped crusher head. The eccentric member is pivotally mounted on the lower frame portion about a crusher axis spaced centrally and vertically relative to the lower frame member. The crusher head is pivotally mounted on the eccentric member about a cone head axis spaced generally centrally and vertically relative to the lower frame portion wherein the cone head axis is angularly offset from the crusher axis and intersects the crusher axis above the crusher head. A crushing chamber is formed between the crusher head and the bonnet.

The mounting arrangement of the gyratory crusher also includes a plurality of hydrostatic bearings for operably supporting the crusher head, a pair of taper bearings configured to operatively provide rotational displacement of the eccentric member about the crusher axis, and a spherical bearing configured to operatively provide rotational displacement of the crusher head about the cone head axis. The crusher head is mounted on a main shaft having a tapped partial bore adapted to threadably receive a mantel stud. One or more partial bores spaced across the threads of the tapped partial bore and the threads of the mantel stud are each adapted to receive a dowel pin as the mantel stud is in threaded engagement with the tapped partial bore. The dowel pin or pins prevent overtightening of the self-tightening mantel stud during crushing operations of the gyratory crusher.

The gyratory crusher also includes a flexible seal that is configured to operatively protect moving components thereof from dust and grit generated during crushing operations. An outer edge of the flexible seal is secured to the crusher head and an inner edge of the flexible seal is secured to an outer race of a ball bearing seal, the inner race of which is secured to non-rotating members of the mounting arrangement.

The gyratory crusher also includes a hydraulic tramp iron relief system that is configured to automatically allow uncrushable material to pass through the crushing chamber. The tramp iron relief system includes channels formed internally within the structure of the lower frame portion to connect cylinders and accumulators of the tramp iron relief system in high-pressure hydraulic fluid flow communication.

The gyratory crusher also includes a self-contained lubricating system configured to operatively lubricate the moving components and sliding interfaces thereof, and to operably transfer thermal energy from the moving parts of the mounting arrangement to the lower frame portion to thereby reduce thermal stress within the crusher.

A driving arrangement, including a bevel gear centered about the crusher axis and secured directly to the eccentric member, provides power for operating the crusher.

PRINCIPAL OBJECTS AND ADVANTAGES OF THE INVENTION

The principal objects and advantages of the present invention include: providing a gyratory crusher that has a flexible dust seal arrangement; providing such a gyratory crusher that has a tramp iron relief system without external plumbing interconnecting cylinders and accumulators thereof; providing such a gyratory crusher that has a self-contained lubricating system; providing such a gyratory crusher that has a hydrostatically supported cone head; providing such a gyratory crusher that has a precisely and accurately located eccentric element relative to lower framework of the crusher; providing such a gyratory crusher that has a drive arrangement attached directly to an eccentric element of the crusher; providing such a gyratory crusher that has a thermal relief system whereby thermal energy from moving parts of a cone head supporting arrangement of the crusher is transferred to a lower framework of the crusher; providing such a gyratory crusher that has easily replaceable parts to minimize maintenance costs; and generally providing such a gyratory crusher that is efficient in operation, capable of long operating life, and particularly well adapted for the proposed usages thereof.

Other objects and advantages of this invention will become apparent from the following description taken in conjunction with the accompanying drawings wherein are set forth, by way of illustration and example, certain embodiments of this invention.

BRIEF DESCRIPTION OF THE DRAWINGS

FIG. 3 is an enlarged and fragmentary, side elevational view of the gyratory crusher, showing one of the plurality of cylinders of the tramp iron relief system with portions broken away to reveal details thereof.

FIG. 4 is a further enlarged and fragmentary, side elevational and cross-sectional view of one of the plurality of cylinders of the tramp iron relief system of the gyratory crusher, taken along line 4—4 of FIG. 3.

FIG. 5 is an enlarged and fragmentary, top plan view of one of the plurality of accumulators of the tramp iron relief system of the gyratory crusher taken along line 5—5 of FIG. 1, with portions broken away to reveal details thereof.

FIG. 6 is a fragmentary top plan view of the gyratory crusher taken along line 6—6 of FIG. 1 with a portion cut away to reveal details thereof, showing a thermal stress relief arrangement thereof.

FIG. 12 is a yet further enlarged and fragmentary view of the gyratory crusher, similar to that of FIG. 10 but showing an alternate dust seal arrangement.

FIG. 14 is a fragmentary and further enlarged plan view of the elevating arrangements of the gyratory crusher.

FIG. 15 is a partial exploded and perspective view of accumulator attaching means of the gyratory crusher, according to the present invention.

DETAILED DESCRIPTION OF THE INVENTION

Figure 1:
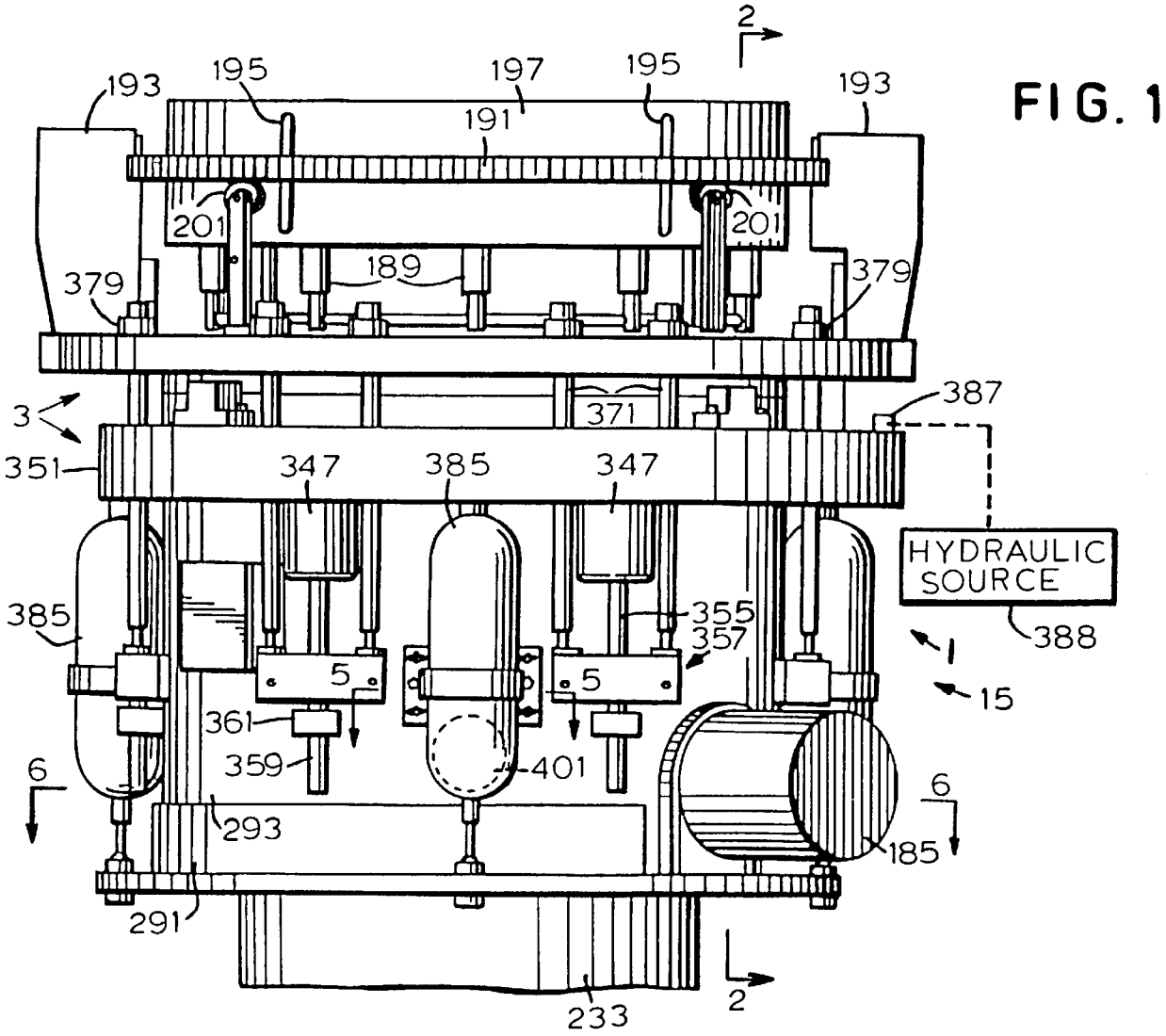
FIG. 1 is a fragmentary, side elevational view of a gyratory crusher including an elevating arrangement and cylinders and accumulators of a tramp iron relief system thereof, according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally refers to a gyratory crusher in accordance with the present invention, as shown somewhat simplified to highlight particular features of the present invention in FIGS. 1 through 15. The crusher 1 includes frame means 3, head mounting means 5, adjusting means 7, lubricating means 9, thermal stress relief means 11, dust seal means 13, and a tramp iron relief system 15.

Figure 7:
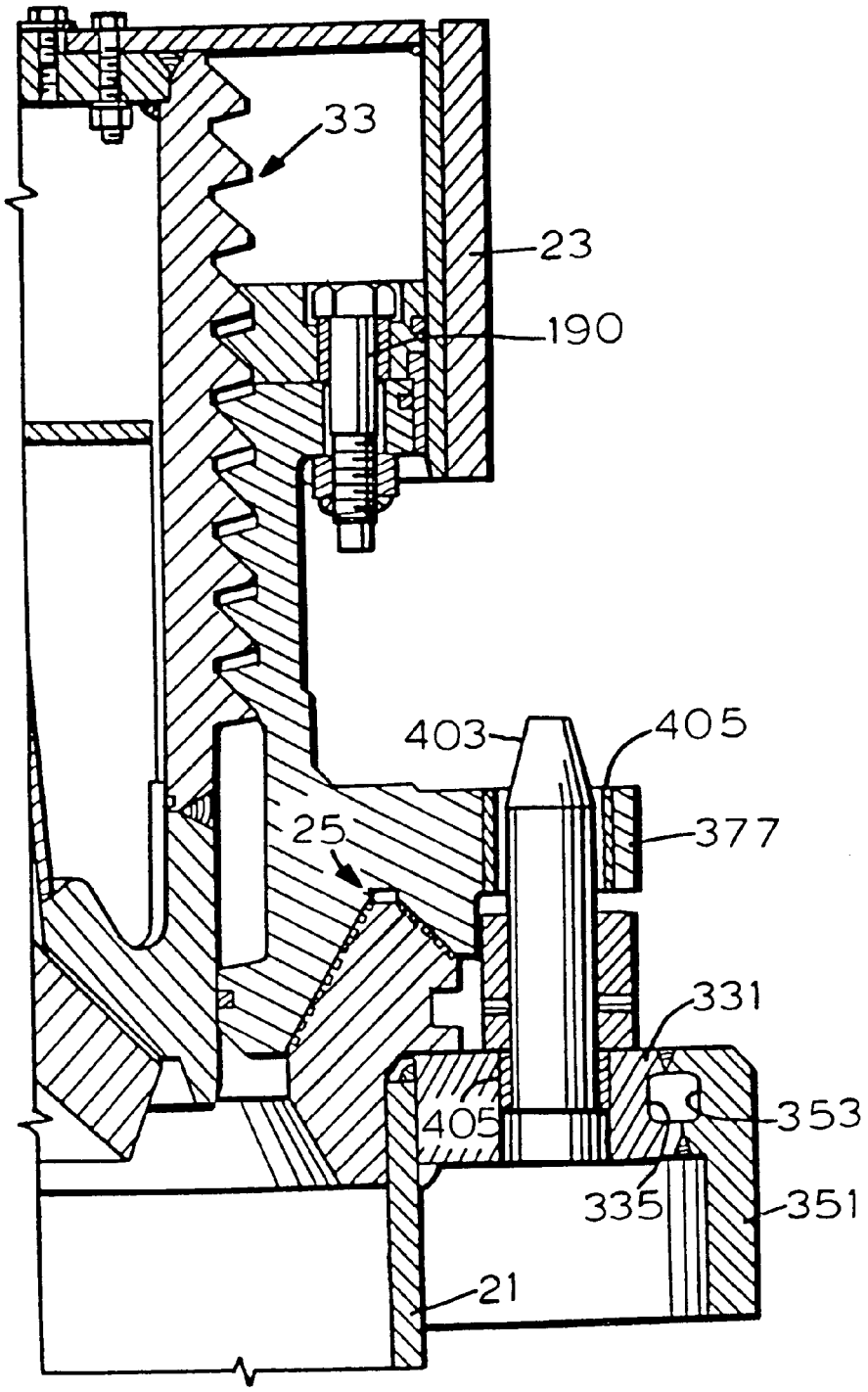
FIG. 7 is a further enlarged and fragmentary, partially cross-sectional and side elevational view of a stop pin arrangement of the gyratory crusher.

The frame means 3 includes a lower frame portion 21 and an upper frame portion 23. A "V-seat" arrangement 25, as shown in FIG. 7, is peripherally situated between the lower frame portion 21 and the upper frame portion 23, similar to that disclosed in U.S. Pat. No. 4,773,604 entitled "Seat Member for Gyratory Rock Crusher Bowls" and issued Sep. 27, 1988. A bowl, concave or bonnet 31 is mounted on the upper frame portion 23 by threads 33. A bowl liner 35 having an exposed surface 37 is replaceably mounted on the bonnet 31 by liner connectors 39. The bowl liner 35 is a wear item that is replaceable while the crusher 1 is shut down during maintenance periods. The upper frame portion 23, the bonnet 31 and the bowl liner 35, which may be collectively referred to herein as an upper assembly 41, are all centered about a vertically oriented crusher axis 51, located centrally through the crusher 1. The bowl liner 35 has the general shape of a hollow truncated pyramid with a generally circularly shaped upper opening 53 and a wider, generally circularly shaped lower opening 55. The upper opening 53 provides a material feed or intake opening for the crusher 1.

Partially located within the bowl liner 35, and extending through the lower opening 55 into the space encompassed by the bowl liner 35, is a crusher head or cone head 61 of the crusher 1. The cone head 61 is generally conically shaped. A mantel 63, replaceably mounted on the cone head 61, provides a conical upwardly facing crushing surface 65 for the cone head 61. The cone head 61 is centered about a generally vertically oriented cone head axis 67, which is disposed and supported at an angle of deviation, as indicated by the numeral 69 in FIG. 2, with respect to the crusher axis 51. The cone head axis 67 and the crusher axis 51 intersect at an apex of gyration or apex 71 that lies centrally above the crusher 1. During the operation of the crusher 1, the cone head 61 gyrates about the apex 71 with respect to the bonnet 31.

Figure 2:
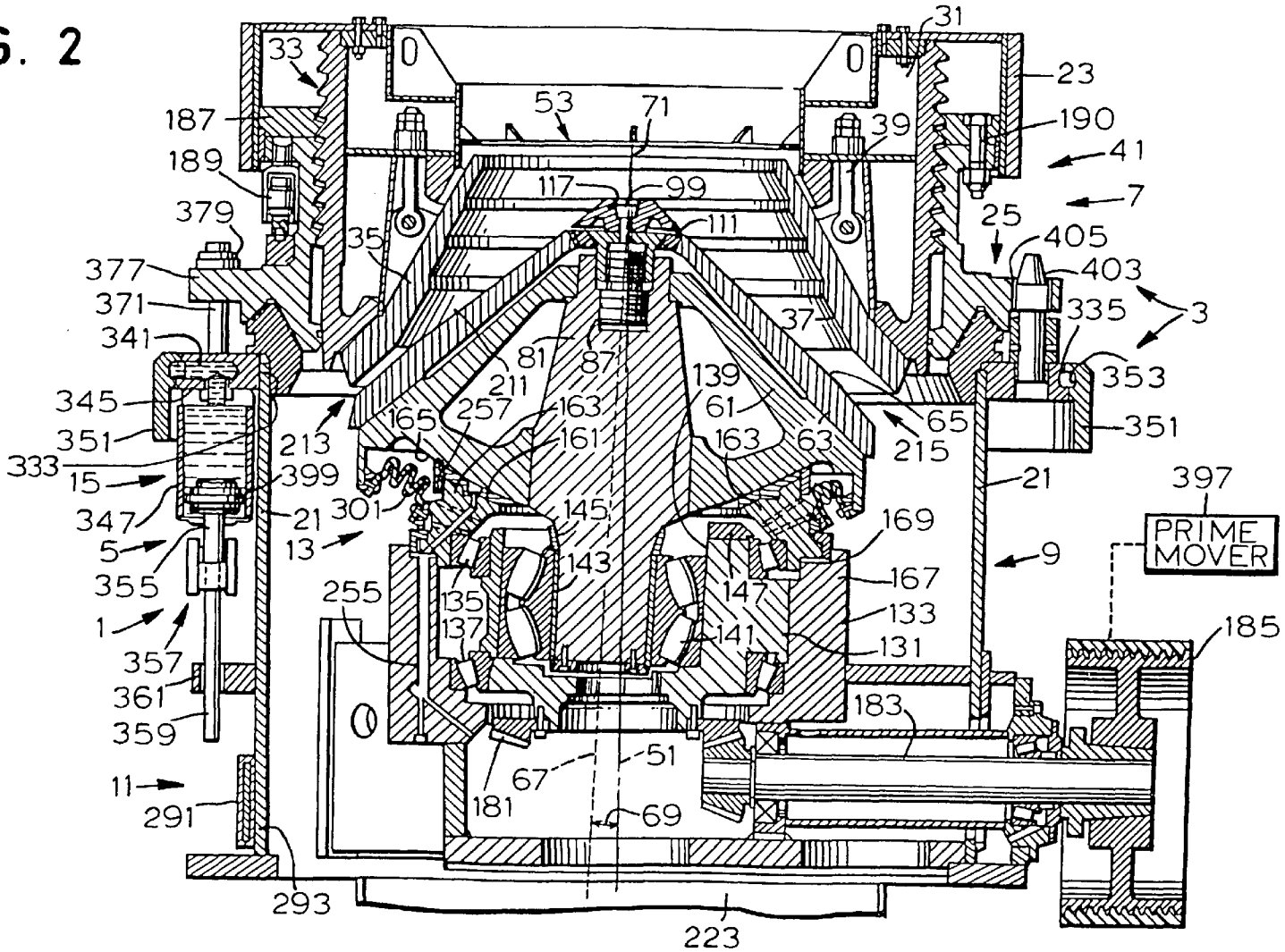
FIG. 2 is a fragmentary, partially cross-sectional view of the gyratory crusher, taken along line 2—2 of FIG. 1.
Figure 9:
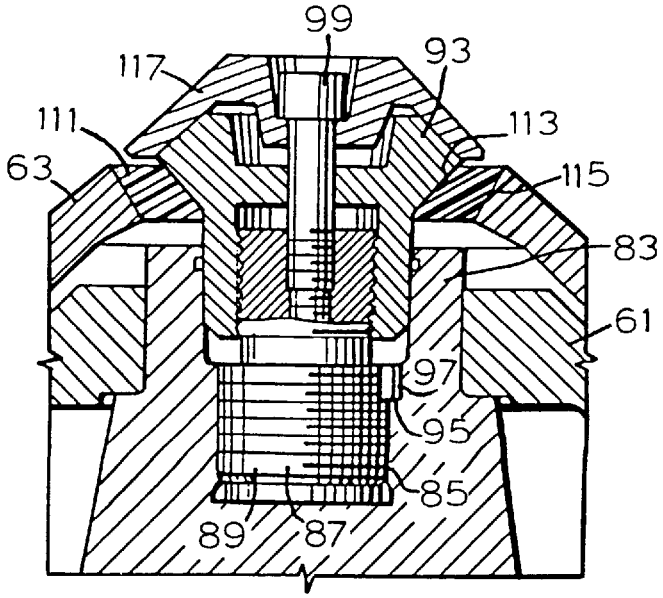
FIG. 9 is a further enlarged and fragmentary, partially cross-sectional view of the gyratory crusher, showing a mantel stud thereof.

The head mounting means 5 includes a main shaft 81, centered about the cone head axis 67, for receiving the cone head 61, as shown in FIG. 2. An upper end 83 of the main shaft 81 has a tapped partial bore 85 for threadably receiving a mantel stud 87, as shown in FIG. 9.

The mantel stud 87 has an inner threaded portion 89 for mating with the partial bore 85 and an outer threaded portion 91 for mating with a mantel nut 93 as hereinafter described. The handedness of the inner threaded portion 89 and the outer threaded portion 91 is such that the mantel stud 87 and the mantel nut 93 are self-tightening. The threads of the inner threaded portion 89 and the outer threaded portion 91 have an appropriate pitch, such as four threads per inch for the outer threaded portion 91 and six threads per inch for the inner threaded portion 89.

At least one, preferably two or more, partial bores 95, axially aligned with the cone head axis 67, are located across the mated threads of the partial bore 85 and the inner threaded portion 89 for receiving a respective dowel pin 97 therein. The dowel pins 97 are adapted to prevent over-tightening of the mantel stud 87 during the crushing operation and to thereby facilitate subsequent removal or replacement of the mantel stud 87, thereby allowing low-cost replacement of a corresponding thread system that holds a mantel bolt 99 without having to remove or replace the main shaft 81.

The mantel 63 is attached to the cone head 61 by placing the mantel 63 on the cone head 61 and placing a mantel washer or "torch ring" 111 over the outer threaded portion 91. The mantel nut 93 is threadably advanced along the outer threaded portion 91. The mantel nut 93 has outwardly tapered shoulders 113 which, in conjunction with the torch ring 111 and an appropriately sized and shaped orifice 115 through the mantel 63, centers and secures the mantel 63 to the cone head 61. A mantel cap 117 is secured to the mantel nut 93 by the bolt 99 to protect the mantel nut 93 and the torch ring 111 from material falling through the upper opening 53.

Figure 11:
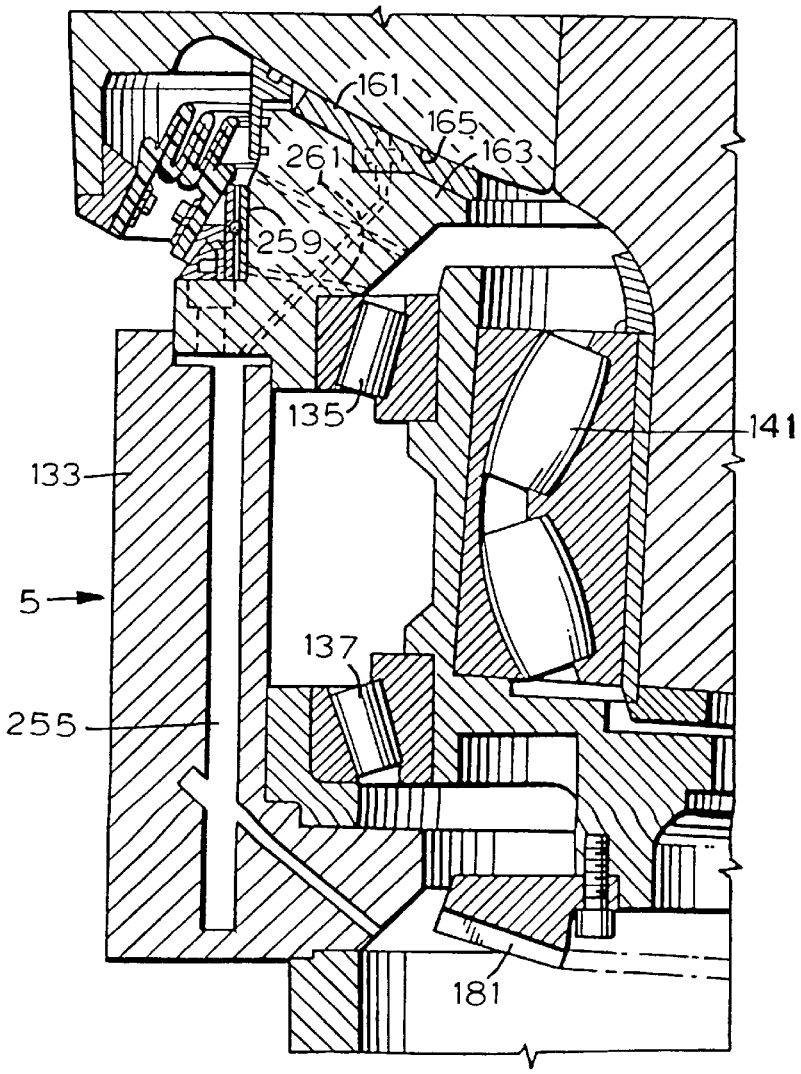
FIG. 11 is a fragmentary view of the gyratory crusher, similar to that of FIG. 10 but showing the dust seal arrangement in the vicinity of an open side setting of the gyratory crusher.

The head mounting means 5 also includes an eccentric member 131 mounted within an encasement portion 133 of the lower frame portion 21. Rotational movement of the eccentric member 131 relative to the encasement portion 133 is provided by a pair of taper bearings 135, 137 centered about the crusher axis 51, as shown in FIG. 11.

A cavity 139, formed within the eccentric member 131, is configured to provide the angular offset 69. Rotational movement of the cone head 61 relative to the eccentric member 131 is provided by a spherical bearing 141 centered about the cone head axis 67. A bushing 143 and a spacer 145 about the main shaft 81 appropriately locate the spacing of the spherical bearing 141 relative to the main shaft 81. Counterweight 147 can be attached to the eccentric member 131 to balance the gyratory forces, as needed.

To provide adequate mounting for the taper bearings 135, 137 while also providing added support for the substantial stress forces generated during the crushing operating, the cone head 61 is mounted in abutting engagement with a plurality of hydrostatic bearings 161, mounted on thrust seats 163 equidistantly spaced around the crusher axis 51. A bottom surface 165 of the cone head 61 is spherically shaped with the center of curvature thereof located at the apex 71 whereby the abutting engagement between the hydrostatic bearings 161 and the surface 165 form a sliding interface as the cone head 61 gyrates during the crushing operation.

The thrust seats 163 are mounted on and jointly supported by an upper side 167 of the encasement portion 133 and the taper bearings 135, 137. The primary purpose for partially supporting the cone head 61 by the taper bearings 135, 137 is to "load" the taper bearings 135, 137. In so doing, the eccentric member 131 is precisely located, both axially and radially, relative to the encasement portion 133. Selected ones of a plurality of shims 169 having different thicknesses provide the desired loading of the taper bearings 135, 137.

By precisely mounting and locating the eccentric member 131 relative to the encasement portion .133 with the taper bearings 135, 137, a gear 181, such as a spiral bevel gear, can be centered about the crusher axis 51 and attached directly to the eccentric member 131, thereby eliminating the more complicated, more expensive and higher maintenance gear arrangements of the prior art arrangements. A drive train or drive pinion arrangement 183, meshed with the gear 181 and connected to a sheave 185 or other suitable means, provides means for powering the crusher 1.

The crushing operation is effected by the spacing between the cone head 61 and the bonnet 31 or, more particularly, the spacing between the mantel 63 and the bowl liner 35. A releasable clamping arrangement 187 jams the opposing threads 33 against each other to prevent relative rotation of the threads 33 except when desired. Preferably, the clamping arrangement 187 is activated by hydraulically operated by appropriately spaced cylinders 189. Alternately, the clamping arrangement 187 may be activated by utilizing bolts and nuts 190.

Wear occurring on the respectively exposed mantel surface 65 and the bowl liner surface 37 tends to increase the spacing therebetween. Consequently, the adjusting means 7, which provides periodic corrective adjustments of the spacing between the mantel 63 and the bowl liner 35, includes the threads 33 which permit continuous adjustment of the axial position of the bonnet 31 in a step-less up or down displacement by rotating the bonnet 31 about the crusher axis 51, a ring gear 191, and a pair of drive motors 193, as shown in FIG. 1.

The adjusting means 7 also includes a plurality, four for example, of vertically oriented cleats 195 secured to a wall 197 of the upper frame portion 23. The ring gear 191 has a corresponding plurality of vertically oriented grooves 199. The ring gear 191, cleats 195 and grooves 199 are configured whereby the ring gear 191 can be displaced vertically alongside the wall 197 but cannot be horizontally rotated relative to the wall 197 due to interaction between the cleats 195 and the grooves 199, as shown in FIG. 14.

The drive motors 193 are mounted on the lower frame portion 21. A plurality of rollers 201, supporting the ring gear 191, are also mounted on the lower frame portion 21 whereby the ring gear 191 is maintained in gearing engagement with the drive motors 193.

To adjust the separation between the mantel 63 and the bowl liner 35, the hydraulic cylinders 189 are bled whereby the jamming pressure between the opposing threads 33 is reduced allowing the drive motors 193 to displace the mating surfaces of the threads 33 relative to each other. Then, the drive motors 193 are activated whereby the ring gear 191 is horizontally rotated. If it is desired to increase the separation between the bowl liner 35 and the mantel 63, the drive motors 193 are operated in unison to cause the upper frame portion 23 to be threadably advanced upwardly. Conversely, if it is desired to decrease the separation between the bowl liner 35 and the mantel 63, the drive motors 193 are operated in unison in the opposite direction to cause the upper frame portion 23 to be threadably advanced downwardly. After attaining the desired separation between the bowl liner 35 and the mantel 63, forces exerted by the clamping arrangement 187 are increased to maintain the newly established separation.

Included conical angles of the bowl liner 35 and the mantel 63 are configured to provide an annular space or crushing chamber 211 between the bowl liner surface 37 and the mantel surface 65, the width thereof generally decreasing downwardly. An annular gap 213 at the lower opening 55 between the bowl liner 35 and the mantel 63 constitutes an annular material discharge opening 215 from the crushing chamber 211. During operation of the crusher 1, material is fed into the crushing chamber 211 through the upper opening 53, which material is gravitationally urged downwardly through the annular crushing chamber 211 and is reduced in size through repeated crushing contacts between the adjacent surfaces 37 and 65 of the bowl liner 35 and the mantel 63.

Figure 8:
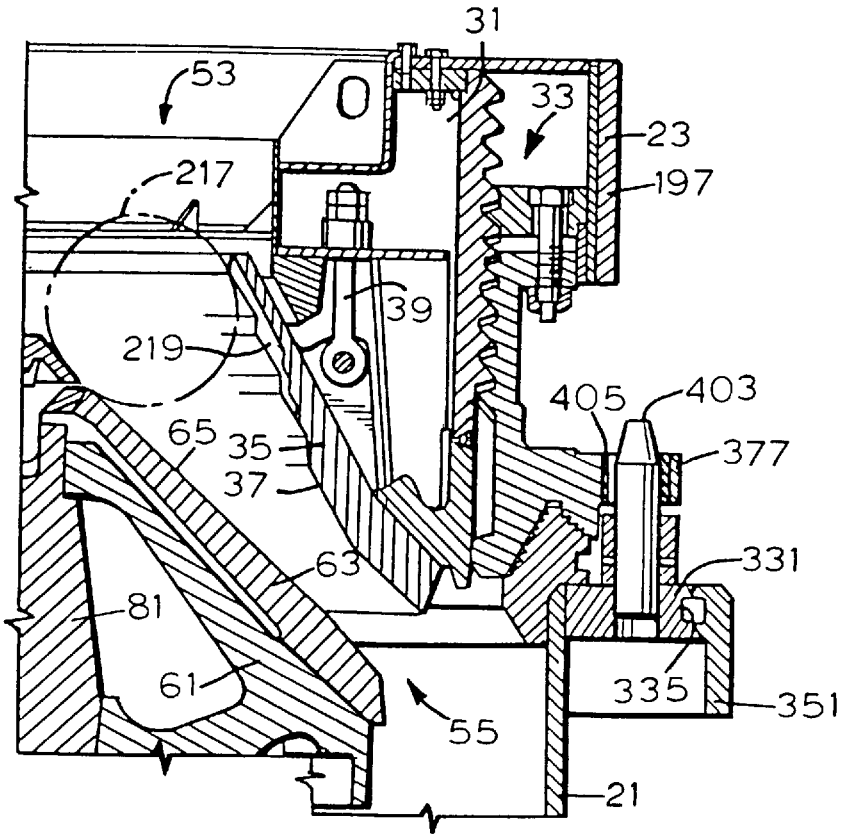
FIG. 8 is an enlarged and fragmentary, partially cross-sectional and side elevational view of a fluted bowl liner of the gyratory crusher.

The maximum size of material that can be crushed by the crusher 1 is determined by the spacing between the uppermost ends of the bowl liner surface 37 and the mantel surface 65, as indicated by the phantom circle designated by the numeral 217 in FIG. 8. If desired, a plurality of flutes 219 may be formed in the bowl liner surface 37, as shown in FIG. 8, whereby occasional oversized material may be received by the crushing chamber 211 to thereby increase the maximum opening of the crushing chamber 211 without increasing the size of the crusher 1.

The lubricating means 9 of the crusher 1 is self-contained and includes a first pumping arrangement 231 for circulating oil through the crusher 1 for lubricating the various moving parts thereof.

Figure 13:
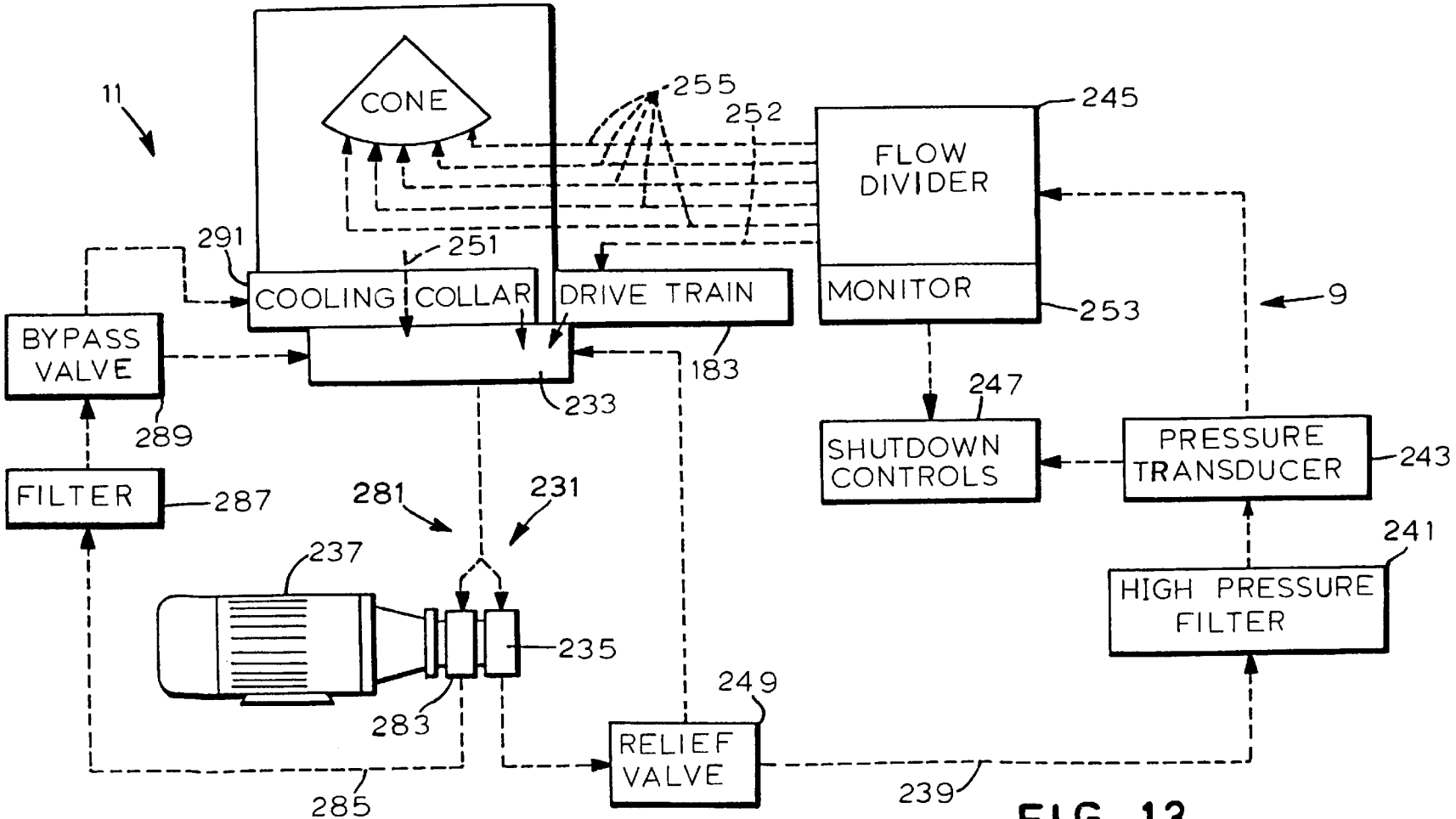
FIG. 13 is a schematic representation of a lubricating system of the gyratory crusher, according to the present invention.

Oil for the first pumping arrangement 231 is contained in an oil pan 233. The first pumping arrangement 231, as schematically illustrated in FIG. 13, draws oil from the oil pan 233 by a lubricating portion 235 of a pump 237 and directs that oil by an oil line 239 through a high-pressure filter 241, a pressure transducer 243 and a flow divider 245. If a failure should occur whereby oil pressure should unexpectedly drop at the pressure transducer 243, such as a broken oil line, the pressure transducer 243 is adapted to signal shut-down controls 247, which immediately shut-down operation of the crusher 1. If, instead, oil pressure in the oil line 239 should exceed a certain pre-determined level, oil will be bled from the oil line 239 by a relief valve 249 and routed back to the oil pan 233.

The flow divider 245 distributes oil flowing therethrough separately to each of the hydrostatic thrust bearings 161 and to the drive pinion arrangement 183, from where the oil gravitationally returns to the oil pan 233, as indicated by the arrow designated by the numeral 251 in FIG. 13. The flow divider 245 also distributes oil to the drive pinion arrangement 183, as indicated by the dashed line designated by the numeral 252.

Monitoring means 253 monitors the volume of oil being processed through the flow divider 245. If oil flow to the hydrostatic thrust bearings 161 or the drive pinion arrangement is reduced significantly or is otherwise interrupted, as evidenced by a reduction in volume of oil flow therethrough as determined by the monitoring means 253, the monitoring means 253 will signal the shut-down controls 247 to immediately shut-down operation of the crusher 1.

Pressurized oil is conveyed from the flow divider 245 to the interface between the hydrostatic bearings 161 and the bottom surface 165 of the cone head 61 by oil channels 255 for lubrication purposes. The oil is sufficiently pressurized whereby the cone head 61 is slightly elevated and supported on a thin film of oil on each of the hydrostatic bearings 161. Oil sprays outwardly from the interface between the hydrostatic bearings 161 and the bottom surface 165 of the cone head 61 and, as it cascades downwardly, lubricates the other moving parts of the head mounting means 5 therebelow. Spring loaded wiper rings 257 cause oil sprayed radially outwardly from the hydrostatic bearings 161 to be directed downwardly onto a seal bearing 259. Weep holes 261 drain oil from the seal bearing 259 and other pockets for gravitational return to the oil pan 233.

The thermal stress relief means 11 is also self-contained and includes a second pumping arrangement 281. The second pumping arrangement 281 draws oil from the oil pan 233 by a cooling portion 283 of the pump 237 and directs that oil through oil line 285 and a filter 287. If the oil temperature should be lower than a pre-determined temperature, a bypass valve 289 diverts the oil from the oil line 285 to the oil pan 233. When the oil in oil line 285 reaches or exceeds that pre-determined temperature, oil is no longer diverted by the bypass valve 289 but, instead, is directed through half-collars 291 abutting a wall 293 of the lower frame portion 21 and into the oil pan 233. The half collars 291, as shown in FIG. 6, and the oil circulated therethrough are adapted to elevate the temperature of the wall 293 to a temperature more closely approximating the temperatures in the head mounting means 5 to reduce thermal stresses within the lower frame portion 21 of the crusher 1.

Actually, the thermal relief means 11 serves a dual purpose. In addition to relieving the thermal stress, the thermal relief means 11 also serves as a cooling means for the lubricating oil.

The dust seal means 13 is adapted to isolate inner moving components, such as the interface between the hydrostatic bearings 161 and the bearings 135, 137 and 141, from abrasive contamination arising from the ubiquitous dust and grit generated during the crushing process. The dust seal means 13 includes a flexible seal 301 having an outer edge 303 secured to a lower extremity 305 of the cone head 61 and an inner edge 307 secured to an outer race 309 of the seal 259, an inner race 311 of which is secured to the thrust seats 163. Bearing balls 312 are captured between the inner race 311 and the outer race 309 in peripheral grooves thereof.

Figure 10:
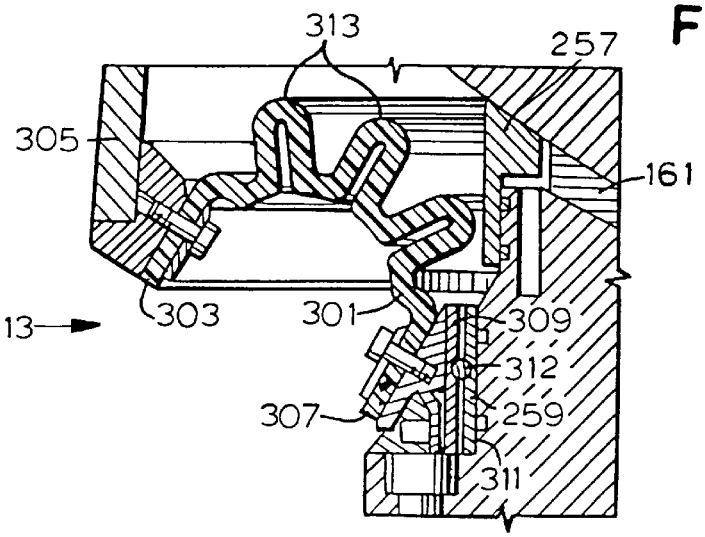
FIG. 10 is a yet further enlarged and fragmentary, partially cross-sectional view of the gyratory crusher, showing a dust seal arrangement thereof in the vicinity of a closed side setting of the gyratory crusher.

To provide the flexibility needed to compensate for the oscillatory displacement of the cone head 61 due to the gyratory motion thereof, the flexible seal 301 generally has a single-wall construction with a corrugation-like cross-sectional configuration, as shown in FIG. 10. As the separation between the mantel 63 and the bowl liner 35 at a particular point along the gap 213 approaches the closed side setting, the corrugations or fingers 313 widen to compensate for the corresponding increasing separation between the lower extremity 305 and the seal bearing 301. Similarly, as the separation between the mantel 63 and the bowl liner 35 approaches the open side setting, the fingers 313 become narrower to compensate for the corresponding decreasing separation between the lower extremity 305 and the seal bearing 301.

To compensate for rotation of the cone head 61 relative to the bowl liner 35 during a crushing operation, the outer race 309 rotates with the cone head 61, peripherally relative to the inner race 311.

Alternatively, the dust seal means 13 may include a flexible seal 321 having a double-wall construction that forms a bladder 323 therebetween, as shown in FIG. 12. For some applications, it may be desirable to pressurize the bladder 323, such as between one to five pounds per square inch.

The tramp iron relief system 15 includes a lower radial member 331 secured to and spaced radially outwardly from an upper end 333 of the wall 293 of the lower frame portion 21. A peripheral groove 335 is formed in an outer edge 337 of the lower radial member 331. A plurality of equidistantly spaced partial bores 341 extend radially inwardly from the groove 335, as shown in FIG. 2. For example, the tramp iron relief system 15 may include eight of the partial bores 341.

In addition, a port 343 is provided from each of the partial bores 341 through a lower surface 345 of the lower radial member 331, as shown in FIG. 3. The ports 343 are spaced outwardly from the wall 293 whereby a cylinder 347, can be connected to and suspended downwardly from a respective one of each of the ports 343. If desired, the cylinders 347 may be connected to the ports 343 by inserts 349, as shown in FIG. 3, preferably constructed of a dissimilar metal, such as brass or other suitable material to minimize or eliminate galling when removing the cylinders 347 from the ports 343. The cylinders 347 are spaced in close proximity to the wall 293.

The tramp iron relief system 15 also includes a skirt 351 secured to the lower radial member 331 as shown in FIG. 4. The skirt 351 extends downwardly from the lower radial member 331 to provide some protection for the cylinders 347. If desired, a groove 353 may be provided along an inner peripheral surface of the skirt 351 to complement and provide greater flow capacity for hydraulic fluid being conveyed along the groove 335.

A piston rod 355 extends downwardly from each of the cylinders 347 and connects to a respective one of a plurality of rocker arm arrangements 357. Each of the rocker arm arrangements 357 has an extension 359 extending through a respective one of a plurality of guides 361. A pair of opposing pull rods 371 extend upwardly from each end of a respective one of the rocker arm arrangements 357, through corresponding openings 373 in the lower radial member 331, and through additional corresponding openings 375 in an upper radial member 377, secured to and spaced radially outwardly from the wall 197 of the upper frame portion 23. Split keepers 379 connected to upper ends of each of the pull rods 371 provide means for hydraulically providing substantial hold-down forces between the upper frame portion 23 and the lower frame portion 21.

The tramp iron relief system 15 also includes a plurality of accumulators 385. For example, the crusher 1 may have one of the accumulators 385 positioned in every other space between the cylinders 347. Each of the accumulators 385 are connected in flow communication with the groove 335, similarly to that provided by the ports 343 and the partial bores 341 for the cylinders 347 and, preferably, by inserts similar to the inserts 349. An appropriately spaced input port 387 is provided for injecting hydraulic fluid into the tramp iron relief system 15 from an external hydraulic source 388, as schematically shown in FIG. 1.

Each of the accumulators 385 are affixed to the wall 293 by accumulator attaching means, comprising a pair of opposing locators 389 and an interconnecting hanger 391. Each of the locators 389 is spaced outwardly from the wall 293 by standoffs 392. The locators have a pair of slots in a base 393 thereof that allows a cylindrical edge 394 thereof to be placed and affixed in abutting engagement with the respective accumulator 385, as shown in FIGS. 5 and 15. The hanger 391 has a threaded connector 395 at each end thereof to clamp the accumulator 385 against the cylindrical edges 394.

One of the distinct advantages provided by the present invention is the elimination of all external plumbing of a hydraulic system for tramp iron relief purposes.

In an application of the present invention, hydraulic fluid is injected into the system to pressurize the hydraulics of the tramp iron relief system 15 to a selected pressure; for example, 2,000–2,400 psi or other suitable pressure as appropriate to clamp the upper frame portion 23 to the lower frame portion 21, particularly across the V-seat arrangement 25.

The closed side setting is adjusted by displacing the bowl liner 35 upwardly or downwardly as needed by clockwise or counterclockwise rotation of the elevating ring gear 191 as appropriate. The first pumping arrangement 231 is activated to provide lubricating oil to the hydrostatic thrust bearings 161 and the drive pinion arrangement 183. The second pumping arrangement 281 is activated to provide oil to the half collars 291 after the oil reaches or surpasses a pre-determined temperature. A prime mover 397, as schematically indicated in FIG. 2, is drivingly engaged with the sheave 185 to initiate gyration of the cone head 61 relative to the bowl liner 35.

Rock, ores or other material are dropped through the upper opening 53 of the bowl liner 35 and are crushed between the mantel 63 and the bowl liner 35 as the material being crushed is gravitationally urged through the crushing chamber 211 to be discharged through the gap 213 thereof. As the crushing operation progresses, the temperature of the oil increases until the pre-determined temperature setting of the bypass valve 289 is reached or exceeded. Then, the bypass valve 289 directs the oil passing through the second pumping arrangement 281 to and through the half collars 291.

The trajectory of crushed material being discharged from the gap 213, which is generally much cooler than the oil, bearings and other moving parts of the crusher 1, causes the crushed material to impact with the wall 293, thereby cooling the wall 293. Due to the temperature difference between the cooled wall 293 and that of the moving components of the crusher 1, prior art crushers endure thermal stresses in addition to the substantial physical stresses inherent in the crushing process. In the present invention, however, the oil circulated through the half collars 291 warms the wall 293, thereby counteracting the cooling effect of the crushed material impacting with the wall 293. As a result, thermal stresses in the crusher 1 of the present invention are substantially reduced from those of prior art crushers.

As non-crushable material that is too large to be processed through the crushing chamber 211, sometimes referred to as "tramp iron", is dropped into the crushing chamber 211, a portion of the bowl liner 35 and the association portion of the upper frame portion 23 are forced upwardly from the cone head 61, causing the corresponding portion of the V-seat arrangement 25 to separate. As the upper frame portion 23 is forced upwardly, corresponding ones of the pull rods 371, which are secured to the upper radial member 377 by the split keepers 379, and the rods 355 connected to the pull rods 371 by the rocker arm arrangements 357 are also forced upwardly.

As the rods 355 are forced upwardly, pistons 399 push hydraulic fluid thereabove into the enclosed peripheral groove 335. The hydraulic fluid flows along the groove 335 to each of the plurality of accumulators 385 connected in flow communication with the groove 335. As the added pressure in the hydraulic fluid is conveyed to the accumulators 385, compressed bladders 401 within the accumulators 385 are further compressed to temporarily store the added mechanical energy caused by the tramp iron passing through the crushing chamber 211.

Immediately after the tramp iron has worked its way through the crushing chamber 211 and dropped from the gap 213, thereby relieving the upwardly thrusting forces previously exerted by the tramp iron, the extra pressure stored in the bladders 401 is dissipated as the upper frame portion 23, which was forced upwardly, returns to its rest position about the V-seat arrangement 25, also returning the pistons 399, the piston rods 355, the rocker arm arrangements 357, and the pull rods 371 to their rest positions. As the V-seat arrangement 25 is disturbed, such as during passage of tramp iron or "bowl float", stop pins 403 prevent rotation of the upper frame portion 23 relative to the lower frame portion 21. Sleeves or inserts 405 are readily removable to facilitate replacement of worn parts interacting with the stop pins 403 and of the pins 403 themselves to thereby minimize maintenance costs.

It is to be understood that while certain forms of the present invention have been illustrated and described herein, it is not to be limited to the specific forms or arrangement of parts described and shown.

What is claimed and desired to be secured by Letters Patent is as follows:

1. A gyratory crusher for crushing material, comprising:

(a) a lower frame portion;

(b) an upper frame portion supported by said lower frame portion;

(c) a bonnet supported by said upper frame portion, said bonnet having an upper opening for receiving the material;

(d) an eccentric member;

(e) a crusher head;

(f) mounting means for pivotally mounting said eccentric member on said lower frame portion about a first axis spaced centrally and vertically relative to said lower frame member, and for pivotally mounting said crusher head on said eccentric member about a second axis spaced generally centrally and vertically relative to said lower frame portion wherein said second axis is angularly offset from said first axis and intersects said first axis above said crusher head and wherein a crushing chamber is formed between said crusher head and said bonnet, said mounting means including a plurality of hydrostatic bearings configured to support said crusher head;

(g) a self-contained lubricating system configured to operatively lubricate said mounting means, said self-contained lubricating means including a flow divider configured to separately distribute lubricant to each of said hydrostatic bearings;

(h) drive means for rotating said eccentric member about said first axis; and (i) monitoring means for monitoring the volume rate of lubricant flowing through said flow divider wherein said monitoring means is configured to operatively signal shut-down of said gyratory crusher as said volume rate decreases below a pre-determined level.

2. The gyratory crusher according to claim 1, including a relief valve configured to prevent pressure of said lubricant to said flow divider from exceeding a pre-determined level.

3. A gyratory crusher for crushing material, comprising:

(a) frame means, including a lower frame portion;

(b) a crusher head having a bottom surface;

(c) mounting means for pivotally and gyrationally mounting said crusher head on said lower frame portion, said mounting means including a plurality of hydrostatic bearings configured to form a sliding engagement with said bottom surface to operatively support said crusher head;

(d) a drive train configured to operatively connect said mounting means to an external power source; and (e) self-contained lubricating means for operatively lubricating said mounting means, said self-contained lubricating means including a flow divider configured to separately distribute lubricant to each hydrostatic bearing of said plurality of hydrostatic bearings, said self-contained lubricating means further including monitoring means for monitoring the volume rate of lubricant flowing through said flow divider, said monitoring means configured to operatively signal shut-down of said gyratory crusher as said volume rate decreases below a pre-determined level.

4. The gyratory crusher according to claim 3, wherein said self-contained lubricating means includes a relief valve configured to prevent pressure of said lubricant to said flow divider from exceeding a pre-determined level.

5. The gyratory crusher according to claim 3, wherein said flow divider is further configured to operatively provide said lubricant to each said sliding engagement of said plurality of hydrostatic bearings such that said crusher head is slightly elevated from said plurality of hydrostatic bearings.

6. The gyratory crusher according to claim 3, wherein said self-contained lubricating means is further configured to operatively provide said lubricant to said drive train.

7. A gyratory crusher for crushing material, comprising:

(a) frame means, including a lower frame portion;

(b) a crusher head having a bottom surface;

(c) mounting means for pivotally and gyrationally mounting said crusher head on said lower frame portion; said mounting means includes a plurality of hydrostatic bearings configured to form a sliding engagement with said bottom surface to operatively support said crusher head;

(d) a drive train configured to operatively connect said mounting means to an external power source; and (e) self-contained lubricating means for operatively lubricating said mounting means and said drive train, said self-contained lubricating means including:

(1) a flow divider configured to separately distribute lubricant to each hydrostatic bearing of said plurality of hydrostatic bearings, said flow divider further configured to operatively provide said lubricant to each said sliding engagement of said plurality of hydrostatic bearings such that said crusher head is slightly elevated from said plurality of hydrostatic bearings, (2) monitoring means for monitoring the volume rate of lubricant flowing through said flow divider, said monitoring means configured to operatively signal shut-down of said gyratory crusher as said volume rate decreases below a pre-determined level, (3) a pressure transducer configured to operatively signal shut-down of said gyratory crusher in the event that pressure of said lubricant to said flow divider decreases below a pre-determined level, and (4) a relief valve configured to prevent pressure of said lubricant to said flow divider from exceeding a pre-determined level.

8. A gyratory crusher for crushing material, comprising:

(a) a lower frame portion;

(b) an upper frame portion supported by said lower frame portion;

(c) a bonnet supported by said upper frame portion, said bonnet having an upper opening for receiving the material;

(d) an eccentric member;

(e) a crusher head;

(f) mounting means for pivotally mounting said eccentric member on said lower frame portion about a first axis spaced centrally and vertically relative to said lower frame member, and for pivotally mounting said crusher head on said eccentric member about a second axis spaced generally centrally and vertically relative to said lower frame portion, wherein said second axis is angularly offset from said first axis and intersects said first axis above said crusher head, and wherein a crushing chamber is formed between said crusher head and said bonnet, said mounting means including a plurality of hydrostatic bearings configured to support said crusher head;

(g) a self-contained lubricating system configured to operatively lubricate said mounting means, said self-contained lubricating means including a flow divider configured to separately distribute lubricant to each of said hydrostatic bearings;

(h) drive means for rotating said eccentric member about said first axis; and (i) a pressure transducer configured to operatively signal shut-down of said gyratory crusher in the event that pressure of said lubricant delivered to said flow divider decreases below a pre-determined level.

9. A gyratory crusher for crushing material, comprising:

(a) frame means, including a lower frame portion;

(b) a crusher head having a bottom surface;

(c) mounting means for pivotally and gyrationally mounting said crusher head on said lower frame portion, said mounting means including a plurality of hydrostatic bearings configured to form a sliding engagement with said bottom surface to operatively support said crusher head;

(d) a drive train configured to operatively connect said mounting means to an external power source; and (e) self-contained lubricating means for operatively lubricating said mounting means, said self-contained lubricating means including a flow divider configured to separately distribute lubricant to each hydrostatic bearing of said plurality of hydrostatic bearings, said self-contained lubricating means further including a pressure transducer configured to operatively signal shutdown of said gyratory crusher in the event that pressure of said lubricant to said flow divider decreases below a pre-determined level.

10. A gyratory crusher, comprising:

a drive system operatively connected to a crusher head, the crusher head being gyrationally supported on a frame by a plurality of hydrostatic bearings; and a lubricating system, the lubricating system including a lubricant supply line defining a flow path, a flow divider disposed in the flow path and being adapted to route lubricant to each of the plurality of hydrostatic bearings, a pump for supplying lubricant under pressure through the supply line to the bearings, and a lubricant monitor being operatively connected to the flow divider, the supply line and the drive system, the lubricant monitor being configured to monitor the volume rate of flow of the lubricant through the supply line and to signal shut down of the drive system in response to the detection of a lubricant flow rate less than a predetermined lubricant flow rate.

11. The gyratory crusher of claim 10, wherein the lubricant monitor includes a pressure transducer disposed in the supply line in order to monitor lubricant pressure through the supply line, the lubricating system further including a relief valve disposed in the supply line in order to divert lubricant out of the supply line in response to the detection of a predetermined pressure condition.

12. The gyratory crusher of claim 10, wherein the flow divider is adapted to direct a portion of the flow of the lubricant to the drive system.

13. The gyratory crusher of claim 10, wherein the frame includes a generally annular flow path in flow communication with the supply line, and further wherein the pump is adapted to pump lubricant through the annular flow path, thereby cooling the lubricant flowing through the system.

* * * * *